United States Patent [19]

Zalis

[11] 4,195,970

[45] Apr. 1, 1980

[54] PISTON PUMP WITH PLANETARY GEAR DRIVE

[75] Inventor: Albert A. Zalis, Warren, Mass.

[73] Assignee: Houdaille Industries, Inc., Fort Lauderdale, Fla.

[21] Appl. No.: 843,955

[22] Filed: Oct. 20, 1977

Related U.S. Application Data

[63] Continuation-in-part of Ser. No. 784,519, Apr. 4, 1977, abandoned.

[51] Int. Cl.[2] ..... F04B 1/19; F04B 39/14

[52] U.S. Cl. ..... 417/269; 417/454

[58] Field of Search ..... 417/270, 271, 260, 454; 91/507

[56] References Cited

U.S. PATENT DOCUMENTS

| | | | |
|---|---|---|---|
| 244,641 | 7/1881 | Mayher | 137/454.4 |
| 918,007 | 4/1900 | Cherry | 417/269 |
| 1,082,156 | 12/1913 | Hurst | 417/269 |
| 1,299,477 | 4/1919 | Kendall | 91/507 |
| 1,545,038 | 7/1925 | Davis | 417/271 |
| 1,695,543 | 12/1928 | Eisenhauer | 417/271 |
| 1,931,543 | 10/1933 | High | 417/269 |
| 1,938,735 | 12/1933 | Andrews | 91/501 |
| 2,083,020 | 6/1937 | High | 91/507 |
| 2,123,815 | 7/1938 | Twaddell | 91/507 |
| 3,958,901 | 5/1976 | Drouet | 417/269 |

FOREIGN PATENT DOCUMENTS

| | | | |
|---|---|---|---|
| 496065 | 3/1930 | Fed. Rep. of Germany | 417/269 |
| 2352217 | 10/1973 | Fed. Rep. of Germany | 417/269 |
| 517948 | 5/1921 | France | 417/269 |
| 724916 | 5/1932 | France | 417/271 |
| 765622 | 6/1934 | France | 417/269 |
| 551384 | 2/1943 | United Kingdom | 417/270 |

*Primary Examiner*—William L. Freeh

*Attorney, Agent, or Firm*—Hill, Van Santen, Steadman, Chiara & Simpson

[57] ABSTRACT

A pump having a planetary gear drive connected to a source of rotary power drives a barrel cam to reciprocate, with a smooth cycloidal motion, a series of pistons operatively connected to the cam. Each piston is reciprocatingly disposed in a cylinder for pumping fluid from a pump inlet to an outlet connected to the cylinders through a series of valve chambers.

14 Claims, 11 Drawing Figures

Fig. 4
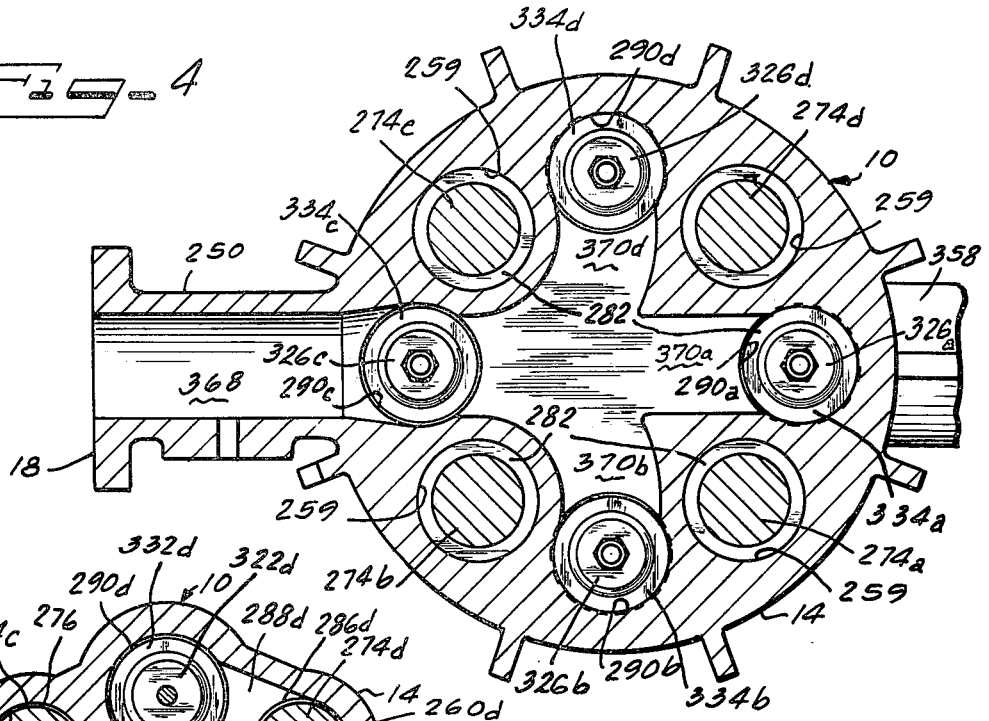
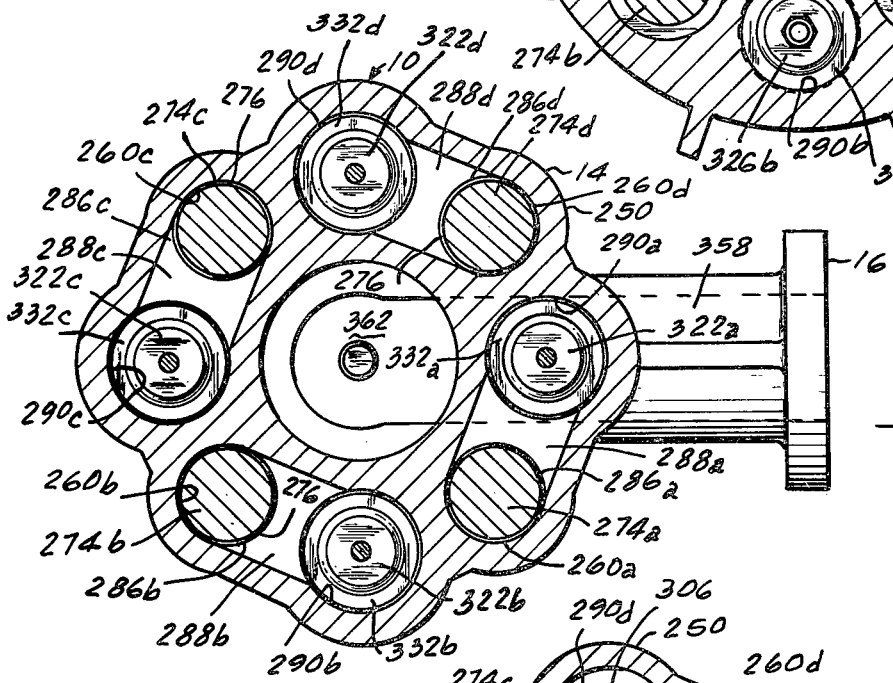
Fig. 5
Fig. 6
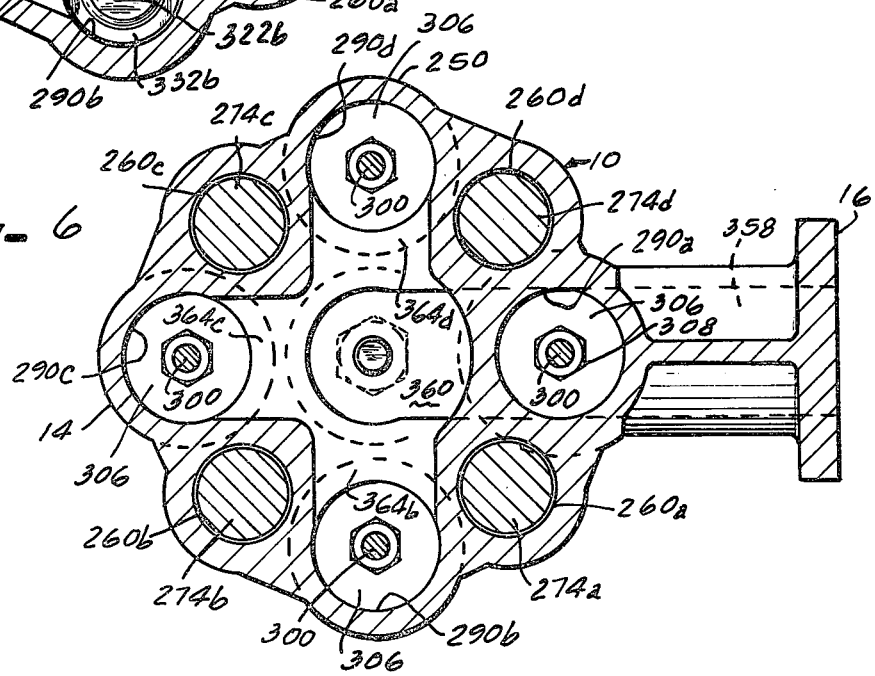

PISTON PUMP WITH PLANETARY GEAR DRIVE

This application is a continuation-in-part of my copending application Ser. No. 784,519, filed Apr. 4, 1977, now abandoned.

BACKGROUND OF THE INVENTION

1. Field of Invention

This invention relates to piston pumps and more particularly to such pumps having a planetary gear driven barrel cam for reciprocating a series of pistons.

2. Description of the Prior Art

Heretofore, pumps having a barrel-type cam to convert a rotary motion into reciprocating motion so as to drive a piston or plunger, have not had rotary speed reduction means as an integral part of such pumps. The designer of such a pump was required to size the components of the pump to be driven at the full revolutions per minute of the rotary source of power or an external reduction means was required between the pump and the source of rotary power.

Further, piston pumps have heretofore been limited in their application, and have generally been characterized by fluid borne pulsations.

The present state of the prior art wherein a camming device converts rotary motion into reciprocating motion is represented by way of example, in U.S. Pat. No. 3,323,461 entitled "METERING PUMP", disclosing a pump in which there are two 180 degree, out-of-phase pistons.

Another example of a pump utilizing a camming arrangement to convert rotary power into reciprocating motion is disclosed in U.S. Pat. No. 3,612,727, entitled "METERING PUMP". Therein only one sealed plunger is utilized and therefore the fluid is only discharged during one-half of the cycle.

SUMMARY OF THE INVENTION

According to the present invention a pump body is divided into a drive section axially aligned with a pumping section. The drive section has a planetary gear drive to reduce input rotational velocity from a power source by a ratio which may approximate 6 to 1. The planetary gear drive actuates a barrel cam shaft supported between spaced bearings located in a lower portion of the drive section. Fixed to the shaft is a barrel cam having an outer peripheral piston driving cam provided with a sign wave-like cam profile which imparts a cycloidal driving motion to the pistons characterized by an advantageous gradual increase and decrease of velocity at the beginning and end of each reciprocal stroke. Disposed at equally spaced intervals about the barrel cam is a series of slippers, each of which carries rotary cam follower means engaging the cam. The slippers are supported within a like number of elongate axially extending complementary guideways located in the drive section.

Attached to each slipper is one end of a respective piston rod which extends into the pumping section of the pump body through packing forming a seal about each rod to maintain separation between the drive and pumping sections. This permits lubricant to be circulated within the drive section for the planetary gear drive and the barrel cam and the related cam followers and slippers, without contaminating fluid being pumped in the pumping section. Attached to the opposite end of each piston rod is a respective piston which is disposed in a respective pumping cylinder in the pumping section of the pump body. A packing assembly provides a seal about each piston at the entrance into the associated cylinder.

Fluid to be pumped enters the pumping section through an inlet which may be in a projection on the pumping section of the pump body, and is drawn into one end of each of a circumferentially spaced series of valve chambers located alternately on substantially parallel axes between the cylinders in the pumping section. Each valve chamber is fitted with a suction valve and seat assembly and a discharge valve and seat assembly which are axially spaced within the valve chamber on opposite sides of a respective cylinder in each instance. At its opposite end, each valve chamber connects through a respective discharge channel leading from the valve chamber with an outlet which may also be in a projection from the pump body.

Each suction valve assembly includes one spring biased valve disk which on the suction stroke of each piston allows an inflow of fluid into the cylinder and on the discharge displacement stroke of the piston compels fluid flow past a similarly constructed and functioning discharge valve to the pump outlet.

Among major features and advantages of the pump as thus described are:

The planetary gear drive which provides a compact yet heavy-duty gear reduction means carried by the drive section of the pump body.

Reduction in the rotational speed at which the pump operates and thus the reciprocating velocity, produces several beneficial results, e.g., the components within the pump may be made large for high volume capacity in a compact body envelope, and liability of cavitation is greatly minimized.

The barrel cam is profiled for efficient cycloidal motion to drive the pistons substantially pulsation free and with gradually increasing and decreasing stroking velocity.

By having the valve chambers of substantially the same volumetric capacity as the cylinders substantially choke-free flow is assured between the pump inlet and outlet.

By having relatively unrestricted flow paths, simple check valving and pistons which pump by fluid displacement rather than direct piston end propulsion and suction, a substantial range of pumping capability and utility is afforded for the pump. For example, the pump is well suited for handling low viscosity fuel oils at elevated pressures where rotary pumps are not suitable and where centrifugal pumps cannot meet the head capacity requirements. Such fuel oils may or may not be contaminated with solid foreign material such as scale and the like. On the other hand, the pump is ideally suited for heavier grade, and more viscous grades of fuel oils which may or may not be contaminated with solid materials.

A principal object of the invention is to provide a new and improved, rugged, efficient, large capacity low speed high pressue pump structure.

Pursuant to the invention there is provided a multipiston pump having an intake and an outlet, comprising a pump body, input shaft means carried by the pump body and adapted for connection to a source of rotary power; speed reduction planetary gear means carried within one section of said pump body, and having means connecting said gear means for driving by said input shaft means to develop reduced-speed rotary driving output power; a rotary barrel cam drivingly connected to said gear means and having sine wave-like peripheral cam profile means adapted for converting said rotary output power to reciprocating motion, a series of cam followers engaging said cam profile means and positioned at spaced intervals about said barrel cam, respective fluid displacement pistons connected to said cam followers and reciprocatable in pumping strokes in respective cylinders in said pump body, fluid intake and outlet means communicating with said cylinders, and valve means controlling displacement of fluid from said inlet means to said outlet means in the pumping strokes of said piston; said cam profile means driving said pistons through said followers with a cycloidal motion throughout a substantial pumping stroke range and with gradual increase and decrease of velocity at the beginning and end of stroke, respectively, with corresponding fluid motion characteristics whereby pumped fluid flow is substantially free from fluid borne pulsations; said pistons being so phased in the series that they generate substantially continuous high pressure pumped fluid flow from said outlet.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure, and in which:

BRIEF DESCRIPTION OF THE DRAWINGS

FIGS. 1A and 1B together are a longitudinal sectional elevational view of a pump embodying features of the invention, and wherein FIG. 1A shows the drive section and FIG. 1B shows the pumping section.

FIG. 4 is a sectional detail view of the pumping section taken substantially along the line IV—IV of FIG. 3.

FIG. 5 is a sectional detail view through the pumping section as viewed along the line V—V of FIG. 3.

FIG. 6 is a sectional detail view through the pumping section as viewed along the line VI—VI of FIG. 3.

DETAILED DESCRIPTION OF PREFERRED EMBODIMENTS

Figure 1A:
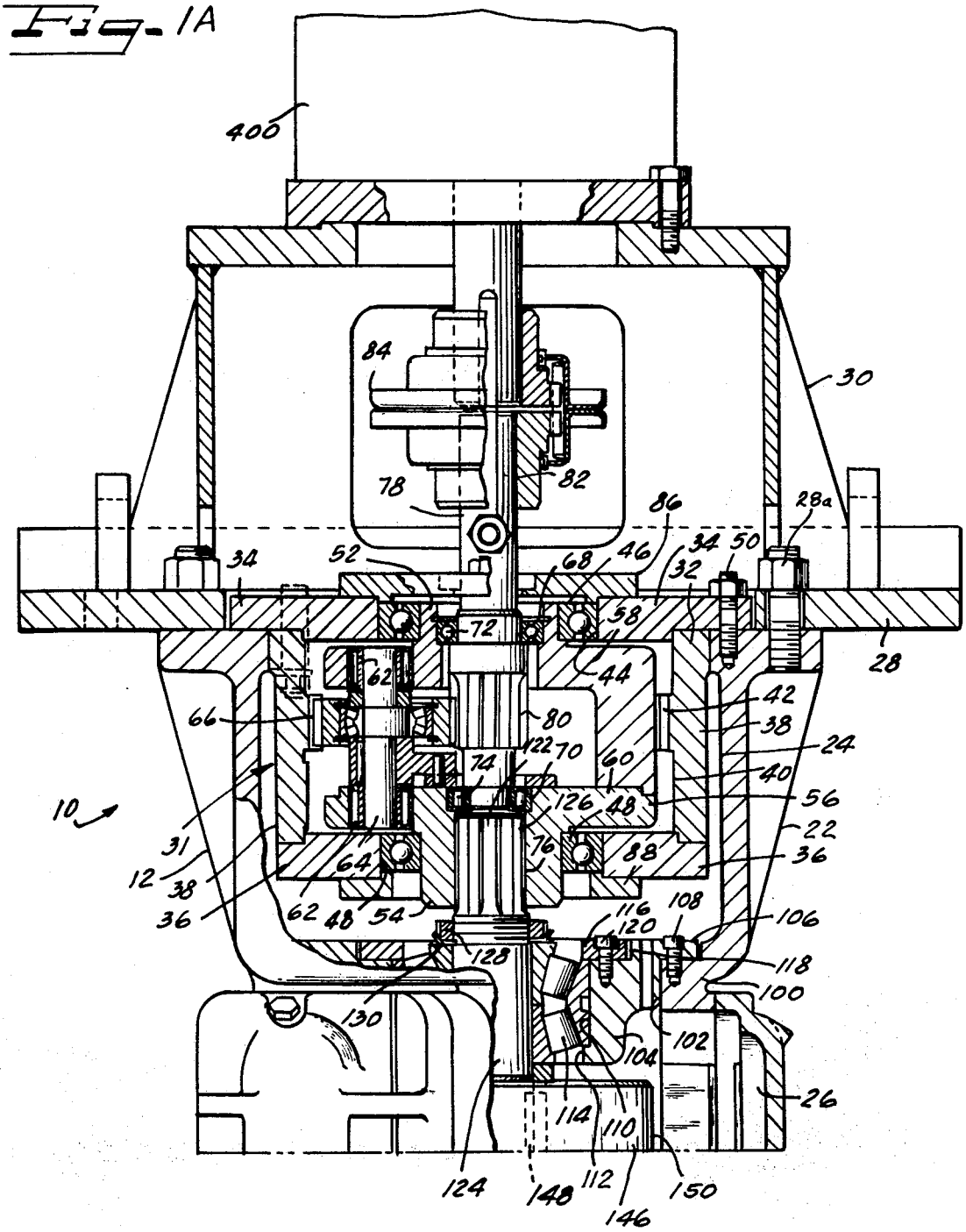
Figure 1B:
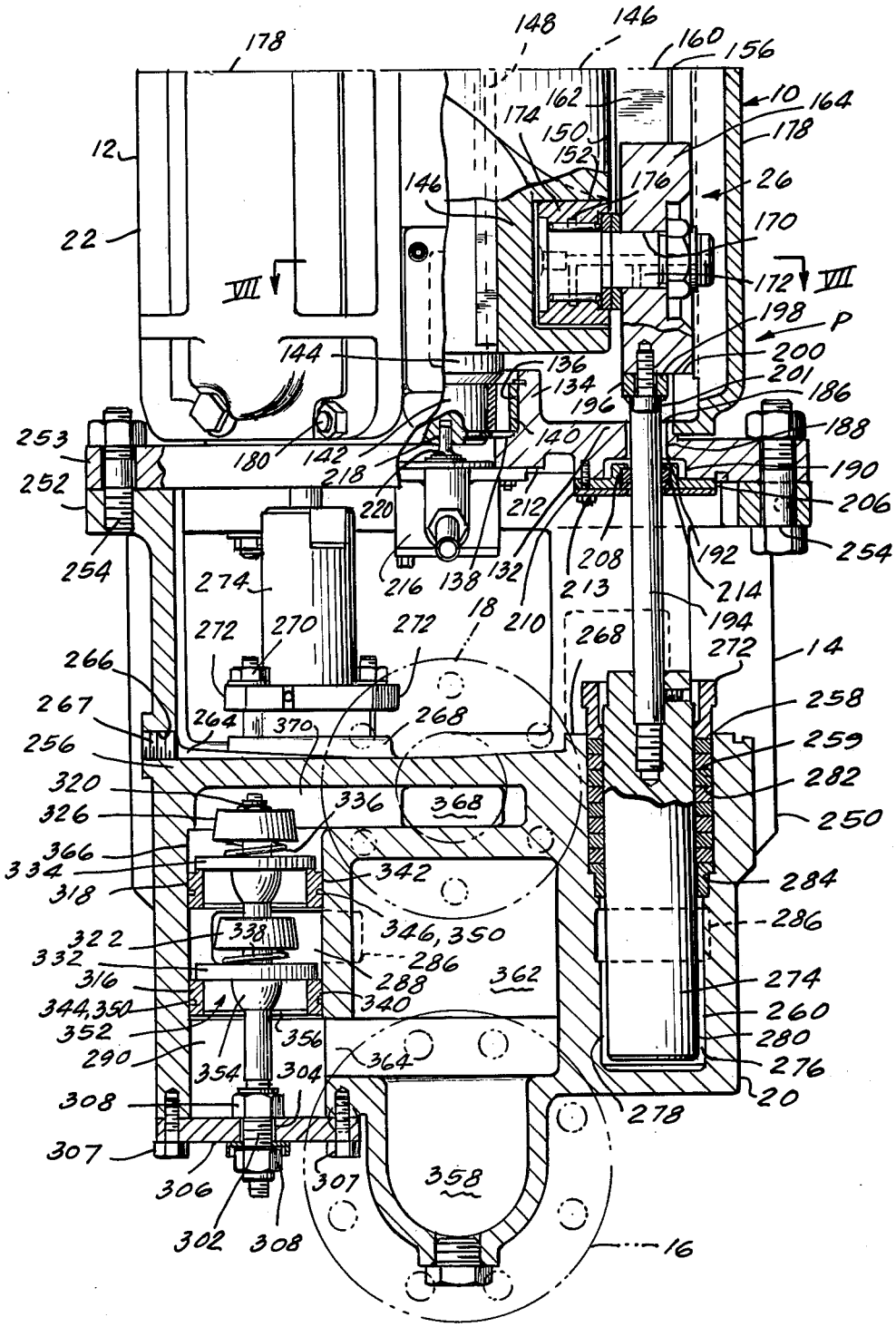

A pump P embodying features of the present invention comprises a pump body 10 having a drive section 12 (FIG. 1A) and a pumping section 14 (FIG. 1B). The pump body 10 may be oriented vertically, with the drive section 12 located above the pumping section 14 with an inlet 16 and an outlet 18 at the lower end portion 20 of the pump body 10. Preferably the inlet 16 and the outlet 18 are positioned about 180 degrees apart with respect to the vertical axis of the pump body 10.

The drive section 12 includes an upper casing 22 which is divided into an upper gear train portion 24 and a lower cam drive portion 26. A generally radially extending mounting plate or flange 28 on the upper end of the casing 22 has the upper end of the casing portion 24 attached thereto as by stud bolts 28a and is adapted to be attached to a structural member on which the pump may be supported. A motor mount 30 is desirably supported on top of the mounting flange 28.

Supported by the flange 28 through the upper casing portion 24 is a planetary gear train assembly 31 including a fixed barrel 32 having a top support ring 34 and a bottom support ring 36 which are vertically spaced and joined to one another by a tubular porton 38. On an inner cylindrical surface 40 of the tubular portion 38 is a relatively large diameter ring of sun gear teeth 42. Each support ring 34 and 36 has an inner concentric circular opening 44, in the upper of which is mounted an upper first planet carrier bearing 46 and in the lower of which is mounted a lower second planet carrier bearing 48. The top support ring 34 is secured to the top of the casing portion 24 as by means of a plurality of fastening screw devices 50.

Journaled within the upper first carrier bearing 46 is a top hub portion 52, and journaled within the lower second planet carrier bearing 48 is a lower hub portion 54 of a planet carrier 56.

A horizontal flange 58 on the hub portion 52 is spaced from a horizontal flange 60 on the hub portion 54, and the flanges 58 and 60 carry three circumferentially spaced pairs of vertically aligned top and bottom needle bearings 62 in which are respectively disposed three vertically oriented planet gear shafts 64. Each of the gear shafts 64 carries one of the three planet gears 66 which mesh with the sun gear 42 on the fixed barrel 32.

The top and bottom hub portions 52 and 54 have respective inner circular openings 68 and 70, in which are disposed, respectively, a top shaft bearings 72 and a bottom shaft bearing 74. The opening 70 of the bottom hub 54 has vertical internal splines 76. Journaled within the shaft bearings 72 and 74 is a power input shaft 78 which carries a central driving gear 80 which is of substantially smaller diameter than the sun gear 42 and positioned to mesh with the three planet gears 66. A top end portion 82 of the input shaft 78 extends upwardly through the top support ring 34 for connection through a coupling device 84 to an external source of rotary power such as a motor 400 on the motor mount 30.

To maintain the planet carrier bearings 46 and 48 within the top and bottom support rings 34 and 36, respectively, the inner circular openings 44 are partially covered, respectively, by a top retainer plate 86 and a bottom retainer plate 88.

In operation of the planetary gear train, rotation of the input shaft 78 drives the driving gear 80 at the same speed. This causes driving of the three planet gears 66 along the relatively large diameter fixed internal sun gear 42 and consequent transfer of rotary motion to the planet carrier 56 at a substantially reduced speed. In the exemplary embodiment, the speed reducton may be on the order of from about 1750 rpm input to about 300 rpm output.

Separating the lower cam drive portion 26 from the upper gear train portion 24 are means comprising an inwardly extending annular flange 100 on the lower end of the casing portion 24 having an inner circular opening 102. Disposed within the opening 102 is an annular bearing support block 104 having an upper end circular outer peripheral rim flange 106 which is fastened to the flange 100 by means of a plurality of bolts 108. The bearing support block 104 has an axial internal vertically disposed circular opening 110 at the lower end of which is an inwardly projecting lip flange 112 supporting the outer race of a tapered roller bearing 114 retained by a retainer ring 116 mounted within an annular recess 118 on a top surface of the bearing support block 104 and overhanging the opening 110. The retainer ring 116 is secured within the recess 118 by means of a plurality of bolts 120.

The outer race of the bearing 114 rotatively supports therein an upwardly projecting portion 122 of a cam shaft 124 having splines 126 meshing with the internal splines 76 of the planet carrier 56. Securing the shaft 124 to the inner race of the bearing 114 is a lock nut 128 threaded onto the shaft 124 above the bearing 114 and locked by a lock washer 130.

At its lower end the cam drive housing portion 26 has a bottom closure part 132 (FIG. 1B) having an upwardly extending hub 134 with a circular central opening 136 formed with a horizontal step 138 to support a bearing 140 within which is journaled a lower end portion 142 of the cam shaft 124. Immediately above the journaled portion 142 on the cam shaft 124 is integrally formed an annular shoulder 144 which serves to support a cylindrically shaped barrel cam 146 which is splined to the cam shaft 124 by a full-length keying device 148. An outer peripheral surface 150 is formed with a 360 degree cam groove 152 having a single sine wave-like cam profile. In the exemplary embodiment, the amplitude of the wave may approximate 4 inches (10 cm).

The lower cam drive casing portion 26 has a number of circumferentially spaced, vertically oriented, rectangularly cross sectioned guideway slots 156 (FIGS. 1B and 7) which in the present instance are four in number and positioned at 90 degree intervals. Each of the slots 156 is formed by two spaced vertical opposing side walls 160, each of which is faced with a flat bearing element 162, and forming a vertical guide for a respective vertically reciprocable slipper 164. Each slipper 164 is of a block-like configuration and includes two oppositely laterally projecting vertical side flange ribs 166 which interface slidably with an outer surface 168 of the cam drive portion 26 and define the inward position of the associated slipper 164. Each slipper 164 further includes a circular horizontal front to back bore 170 through which extends a cam follower shaft 172 which projects inwardly and supports a cam follower in the form of a roller 174 rotating on a needle bearing 176. The cam follower 174 engages operatively within the groove 152 of the barrel cam 146. Because each slipper 164 is positioned at a 90 degree interval about the casing portion 26, each cam follower 174 is at a respective 90 degree phase of the sine wave-like profile of the cam groove 152. Each of the slippers 164 is retained in place by means of a respective cover plate 178 secured to the casing portion 26 by means of a plurality of bolts 180. The cover 178 has a dish-shaped cross-sectional configuration so as to provide a recess space 182 to clear the outer end of the associated shaft 172 between spaced vertical bearing segments 184 located to be engaged slidably by an outer surface of the ribs 166 of the slipper 164.

In the bottom closure part 132 are longitudinally extending circumferentially spaced piston rod clearance bores 186 (FIG. 1B) respectively aligned with the slippers 164, i.e., four of the bores 186 spaced 90 degrees apart. Each of the bores 186 includes an upper portion 188 and a lower enlarged portion 190 defining a horizontal recess 192. Through each bore 186 extends a piston rod 194, having at its upper end 196 a crosspiece 198 which is fastened to a bottom surface 200 of the associated slipper 164 by fastening means such as screws 201. A lubricant seal about each respective piston rod 194 is provided by a stuffing box 206 having a cup-shaped retainer 208 accommodated in the recess 192 and attached together with a compression plate 210 to a bottom surface 212 of the bottom closure 132 by fastening means such as screws 213. Packing material 214 is compressed about the piston rod 194 within the retainer 208 of the stuffing box 206.

The circular opening 136 in the hub 134 of the bottom closure 132 accommodates a lubricant circulation pumping device 216 which is fastened to the bottom surface 212 of the closure 132. The device 216 has a rotary impeller driven by the barrel cam shaft 124 which has a slot 218 formed in its bottom end 142 and within which is keyed a flatted top end of a shaft 220 of the lubrication pumping device impeller which is thereby rotatably driven. Lubricant is circulated by the pumping device 216 into the top of the gear train portion 24 of the upper casing 22 and flows downwardly by gravity to lubricate all of the moving parts within the upper and lower portions of the casing 22. A sight glass (not shown) may be provided for visual observation of the level of lubricant within the cam drive portion 26 of the housing.

The pumping section 14 comprises a casing 250 having an upper hollow portion with a top attachment flange 252 which is attached to a lateral flange 253 on the bottom closure 132 of the upper casing 22 by means of a plurality of studs or bolts 254.

The lower portion of the casing 250 is formed to provide an integral pumping block 256 in which there are vertical blind end plunger bores 258 opening upwardly and coaxially aligned with the piston rods 194. Each of the bores 258 has an upper packing counterbore 259 and a lower piston cylinder 260. In this instance, there are four of the bores 258 and the four piston cylinders are identified in FIG. 6 as 260*a* to *d*, respectively. The top of the block portion 256 has a dished configuration to provide a runoff surface into a central sump area 262 (FIG. 3) which can be conveniently drained through a radially disposed channel 264 (FIG. 1B) communicating with a port 266 normally closed by a plug 267. Projecting upwardly from the sump area 262 are lands 268 respectively formed about each of the bores 258 receiving means such as bolts 270 for driving a pair of split semi-cylindrical packing gland thrusters 272 into the upper ends of each of the counterbores 259.

Fixedly secured to the lower end of each piston rod 194 in the present embodiment of the invention is a cylindrical pumping plunger piston 274 having a differentially smaller diameter to provide a space 276 between the cylindrical wall 278 of the cylinder 260 and the longitudinal peripheral surface 280 of the piston 274. Thereby the pistons 274 are free from direct contact with the cylinder walls 278 throughout pumping and suction strokes. The four pistons 274 in the present embodiment are designated as 274*a* to *d*, respectively, in FIGS. 4, 5 and 6.

Seal against escape of pumping pressure from the cylinders 260 is by means of a respective stack of packing rings 282 in each packing counterbore 259 and engaging about each piston 274 and retained under compression against a bottom compression ring 284 by the pair of split gland thrusters 272 to which compression pressure is applied by the bolts 270.

Each cylinder 260 has a common inlet/outlet port 286, identified as 286*a* to *d* in FIG. 5, and located adjacent to the top of the cylinder 260 in each instance. Each port 286 is part of a horizontal channel 288, designated as 288*a* to *d* in FIG. 5. Each channel 288 communicates substantially midway between the upper and lower ends of an associated companion respective vertically disposed blind end bore downwardly opening valve chamber 290 (FIG. 1B), of which there are four designated as 290*a* to *d* in FIGS. 4, 5 and 6 alternating at 90 degree intervals about the vertical axis of the pump body 10 with the cylinders 260 *a* to *d*.

Within each valve chamber 290 is a valving assembly 298 constructed and arranged as a unitary assembly to be inserted through the open end of its chamber 290. Each valving assembly 298 comprises a vertically disposed valve rod stud 300 extending throughout substantially the length of the chamber 290 and having a threaded lower end 302 which extends through a stud bore 304 in a valve chamber cover plate 306 and is secured by means of two nuts 308 located one on each side of the cover plate 306. The cover plates 306 are secured by means of studs or screws 307 in sealed relation respectively to bottom access openings 310 for each of the valve chambers 290.

Figure 3:
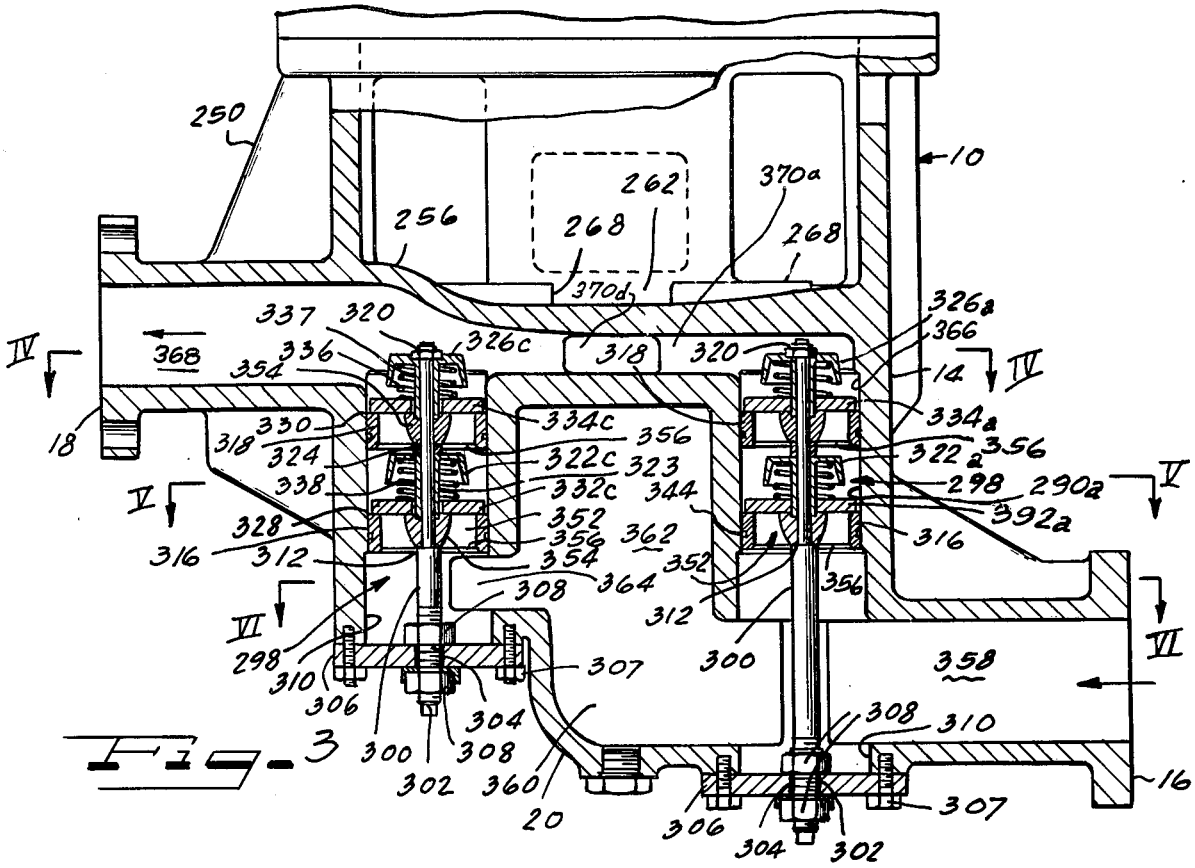
FIG. 3 is a sectional elevational view of the pumping section turned about 90 degrees from the orientation of FIG. 1B.
Figure 2:
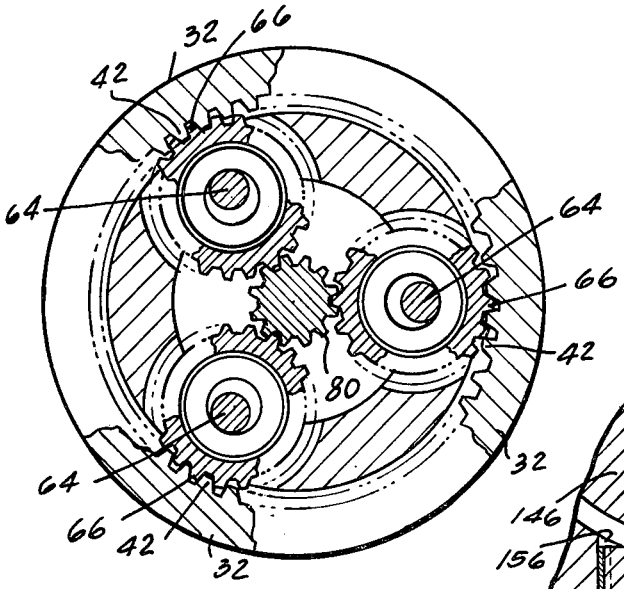
FIG. 2 is a sectional view of the planetary gear train as viewed along the line II—II of FIG. 1A.

An upper portion of each valve stud 300 is of smaller diameter than the lower portion thereof and this provides a shoulder 312 facing upwardly at the juncture and providing locating support for a suction valve seat ring 316 and a discharge valve seat ring 318 in a stacked assembly on the valve stud 300 and retained thereon by means of a nut 320 threaded onto a top end of the valve stud 300. The seat ring 316 is carried by an integral spider comprising a central hub 354 engaging the seat 312 and having lateral arms 356 connecting the ring seat and the hub integrally together and with flow passage 352 between the hub and the ring seat. Reciprocably seated on the seat 328 provided by the seat ring 316 and on the upper end of the hub 354 is a valve disk 332 in each of the valve assemblies 298, the respective valve disks being identified as 332*a* to *d* in FIGS. 3 and 5. Normally maintaining the valve disk 332 on its seat in each instance is yieldable biasing means in the form of a coiled compression spring 338 thrusting at its lower end against the valve disk and at its upper end thrusting into a generally cup-shaped thrust shoulder and retainer 322 having a hollow stem 323 extending downwardly through the spring and a central bore in the valve disk 332 and bottomed against the hub 354. In FIGS. 3 and 4 the shoulder members 322 are variously identified as 322*a* to *d*.

Whereas the valve seat ring 316 is located below the associated channel 288, the valve seat ring 318 is mounted to be located above the channel 288 and is also supported by a spider comprising hub 354 and radial connecting arms 356, the hub being engaged about the stud 300 and resting on a spacer 324 on top of the spring shoulder member 322. A valve disk 334 rests upon upper valve seat 330 on the ring 318 and is upwardly reciprocable but normally held to its seat by biasing means comprising a compression spring 336 thrusting at its lower end against the valve disk 334 and at its upper end against a fixed shoulder member 326 having a tubular stem about the upper end portion of the rod stud 300 and projecting downwardly through a cental aperture in the valve disk 334 and bottomed against the upper hub 354, with the nut 320 locking the assembly through the stem 337 and the underlying fixed parts against the shoulder 312. It may be observed in FIGS. 3 and 4 that the spring thrust shoulder retainers 326 are identified as 326*a* to *d*, respectively for the annular series of valving assemblies, corresponding to the valves 334*a* to *d*, respectively. Through the described arrangement each of the valving assemblies 298 is adapted to be fully bench assembled and then inserted into its respective valve chamber 290 through the lower end opening 310, until the cover plate 306 engages its seat to which it is fixedly and sealingly secured. After being thus mounted in its valve chamber, each of the valving assemblies 298 has the lower valve disk 332 located below the channel 288 and the upper valve disk 334 located above the channel 288.

Each valve seat ring 316, 318 has an outer cylindrical surface, identified as 340 and 342 (FIG. 1B) respectively provided with a circumferential groove 344, 346, respectively, having therein a respective O-ring 350 to provide a seal against leakage between the seat rings 316 and 318 and the walls of the chamber bores 290.

The intake 16 of the pump body 10 connects with the valve chambers 290*a* to *d* through a horizontal intake passage 358 (FIG. 3) having an inner end 360 communicating freely with a vertical intake chamber 362 substantially aligned with the vertical axis of the pump body 10.

The valve chamber 290*a* is aligned with the intake passage 358 and communicates directly therewith for exposure of the underside of the valve plate 332*a* to intake fluid.

The vertical intake chamber 362 communicates respectively with the valve chambers 290*b*, 290*c*, and 290*d* through respective horizontal connecting ports 364*b*, 364*c* and 364*d* (FIG. 6) located below and spaced sufficiently from the horizontal channels 288*b* to *d* to allow disposition of the suction valve seats 316*b* to *d* and their respective valve plates 332*b* to *d* therebetween.

The pump discharge 18 (FIGS. 1B, 3 and 4) is in communication with a respective discharge end 366 at the upper end of each valve chamber 290*a* to *d* by means of lateral discharge channel 368. Three passages 370*a*, 370*b* and 370*d* connect the upper ends 366 of the valve chambers 290*a*, 290*b* and 290*d*, respectively with the discharge channel 368, which communicates directly with the upper end of the valve chamber 290*c*. All of the connecting passages 370 are located above and spaced sufficiently from the horizontal channels 288*a* to *d* to allow disposition of the discharge valve seats 318 and the respective valve plates 334*a* to *d* therebetween.

In operation of the pump P, the source 400 (FIG. 1A) of rotary power rotates the power input shaft 78. Because of the planetary gear train assembly 31, the output rotation speed of the planet carrier 56 is reduced significantly. For example, an about 1750 rpm input may be reduced to about 300 rpm.

The planetary assembly drives the cam shaft 124 and the attached barrel cam 146 to effect reciprocation of the slippers 164*a* to *d* through the cam followers 173*a* to *d*, and thereby of the four piston rods 194*a* to *d*, and the pistons 274*a* to *d* coupled to the rods.

The cam followers 174*a* to *d*, and thereby the pistons 274*a* to *d* likewise, are positioned at 90 degree intervals about the barrel cam 146 with respect to the sine wave-like cam groove 152. The sine wave profile of the cam groove 152 is such that the pumping stroke of each of the pistons is 90 degrees out of phase with respect to the two adjacent pistons in each instance, but the combined output of the pistons provides a substantially continuous pulsation free pump output.

As the piston 274*a* approaches the top of its stroke, the piston 274*c*, located 180 degrees therefrom, approaches a bottom point in its stroke. The two remaining pistons 274*b* and 274*d* are moving with maximum downward and upward velocity, respectively.

By having the cam profile of the cam groove 152 generated in sine-wave-like form with smoothly rounded transition at top of stroke and bottom of stroke, a cycloidal stroking motion is imparted to the pistons which results in very gradual increase and decrease of velocity at the beginning and end of stroke but with maximum stroking velocity between the beginning and end of stroke. Fluid borne pulsations are minimized to the point that operation of the multi-piston pump of the present invention is comparable in smoothness of operation to a centrifugal or rotary pump in that the pumping operation is for practical purposes pulseless.

The pumping action may be best explained by considering only one piston and beginning at the point in the cycle where the piston, as an example piston 274*c*, has reached the bottom of its stroke. At this point, the piston 274*c* will occupy a maximum volume of the plunger chamber 260*c* with only a small amount of liquid remaining about the plunger 274*c* in the space 276 and in the horizontal channel 288*c* connecting the cylinder 260*c* with the valve chamber 290*c*. At this point a supply of fluid fills the intake passage 358, the vertical intake chamber 362 and the bottom portion of the valve chamber 290*c*.

As the plunger 274*c* moves upwardly, a vacuum suction is created in the cylinder 260*c*, resulting in a pressure differential between the cylinder 260*c* and the intake 16 of the pump body 10. This pressure differential is sufficient to overcome the pressure of the spring 338 on the valve plate 332*c* which separates from its valve seat 328. This allows an inflow of fluid into the valve chamber 290*c* above the suction valve seat 328 through the horizontal channel 288*c* and into the cylinder 260*c*. The discharge valve plate 334*c* remains in place because the pressure of the spring 336 together with the pressure of the fluid in the horizontal discharge channel 368 is sufficiently greater than any pressure below the valve plate.

Inflow of liquid into the cylinder 260*c* continues until the piston 274*c* reaches the top of its stroke at which point the suction valve plate 332*c* will again be sealed against the valve seat 328 by the spring 338.

As the piston 274*c* starts its downstroke, fluid is displaced from the cylinder 260*c*, passes through the horizontal channel 288*c*, into the valve chamber 290*c* and upward past the valve 334*c* and into the channel 368. The pressure of the pumped fluid overcomes the bias of the spring 336 on the discharge valve plate 334*c* to unseat it from the valve seat 330 and allow passage of the fluid into the discharge channel 368 of the outlet 18.

Because of the concerted action of the four progressively phased pistons 274*a* to *d* in the cycloidal pumping action the outflow of liquid is smooth and substantially pulseless.

Figure 7:
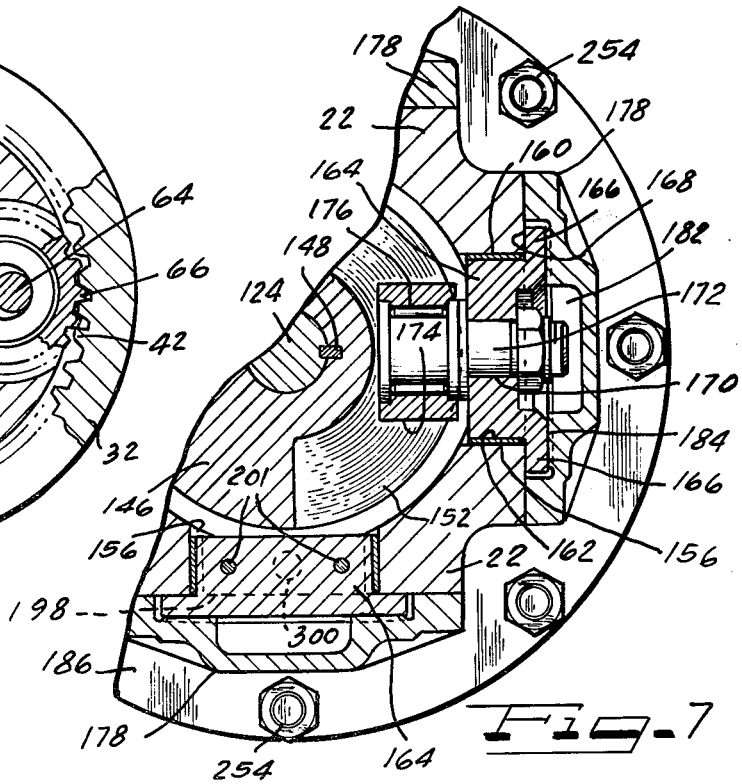
FIG. 7 is a fragmentary sectional detail view taken substantially along the line VII—VII of FIG. 1B.
Figure 8:
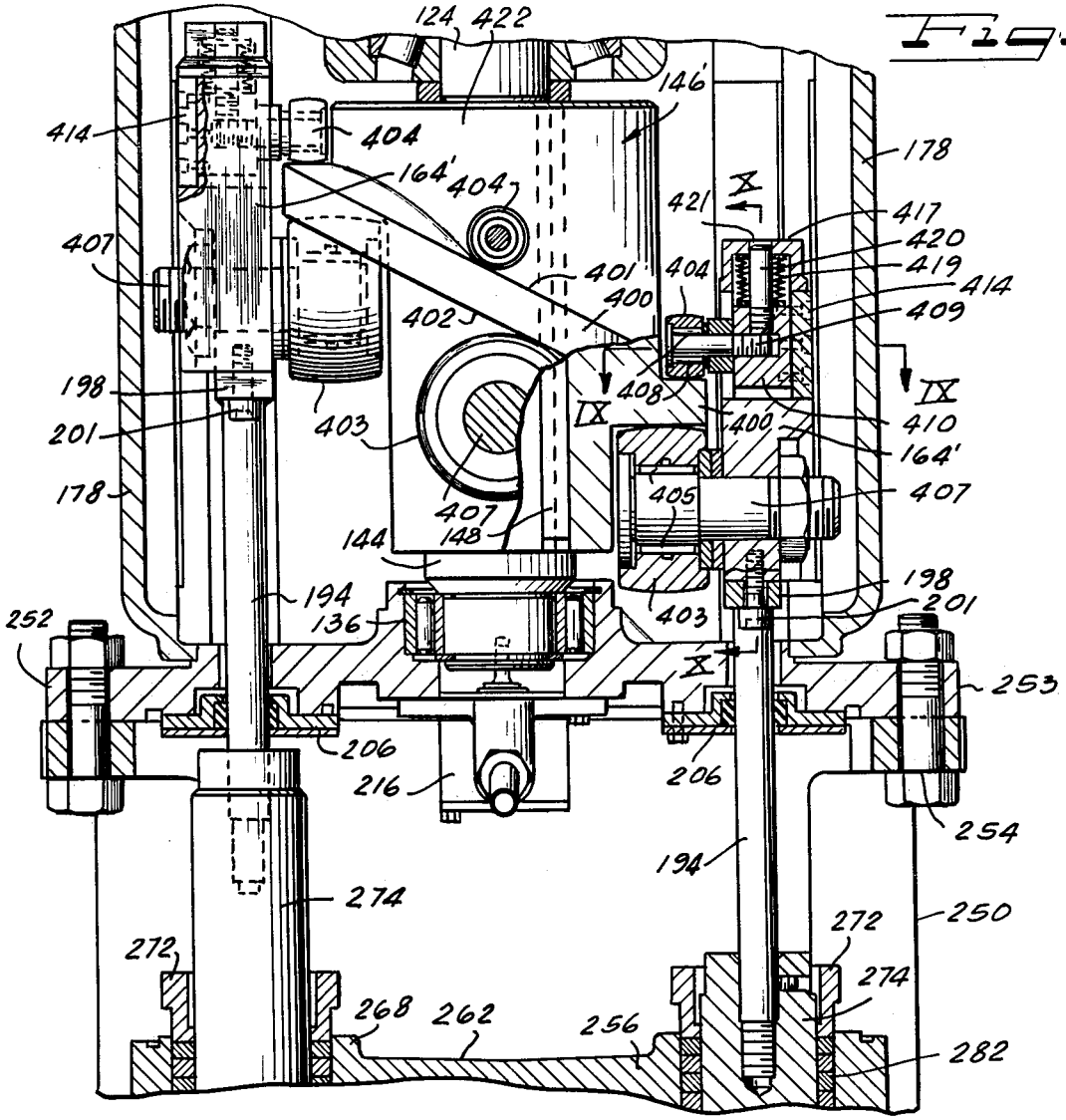
FIG. 8 is a fragmentary vertical sectional elevational view showing a modification in the piston driving barrel cam and follower structure.
Figure 9:
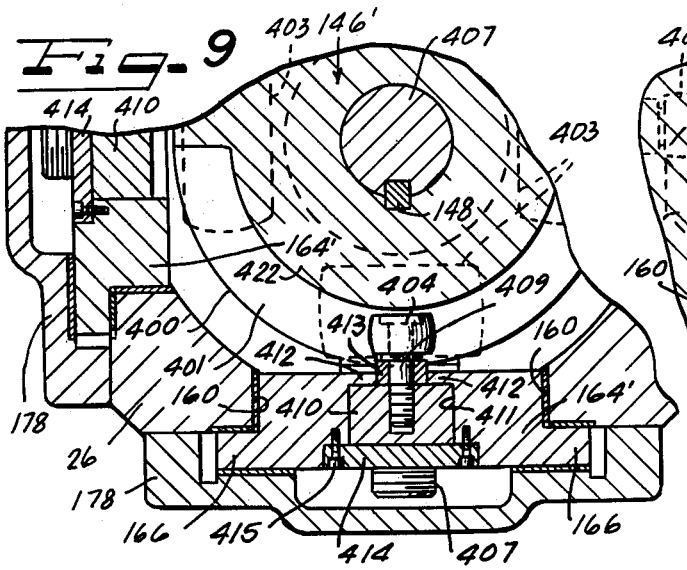
FIG. 9 is a fragmentary sectional plan view taken substantially along the line IX—IX of FIG. 8.
Figure 10:
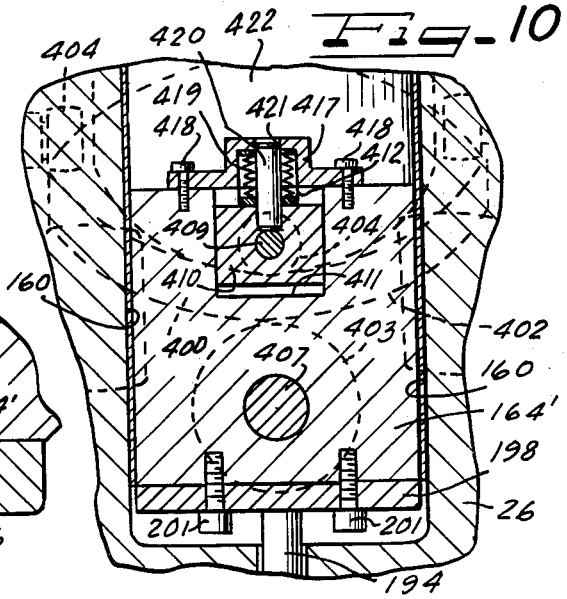
FIG. 10 is a fragmentary vertical sectional detail view taken substantially along the line X—X of FIG. 8.

In the piston drive arrangement of FIGS. 1*b* and 7, the cam follower roller 174 is required to reverse rotary direction in each cycle of operation of the barrel cam and piston system. Such reversal of rotary direction of the cam follower is avoided by the arrangement disclosed in connection with FIGS. 8, 9 and 10, wherein, features of the pump are identical with those already described except for the barrel cam and piston driving transmission system structure. In this modified arrangement, the barrel cam 146' is of smaller diameter than the barrel cam 146 and instead of a cam groove is provided with a peripheral flange cam track 400 having exactly parallel upper and lower cam track surfaces 401 and 402, respectively. These cam track surfaces 401 and 402 are generated in the same sine wave form as the cam track surfaces in the cam groove 152 in the barrel cam 146 so that the pumping results attained by means of the flange cam track 400 are the same as have already been described.

Rotary motion of the barrel cam 146' is converted into reciprocal pumping motion in the pistons 274 by means of a cam follower transmission similar to the cam follower transmission involving the rollers 174, except that the cam following function is effected by means of a pair of follower rollers 403 and 404 in the motion conversion and transfer system for each of the pistons 274, and wherein the follower roller 403 is of more massive construction engaging the lower pumping stroke driving cam surface 42 and the follower roller 404 is of a less massive construction and smaller diameter for space saving purposes and rides the upper suction stroke cam surface 401. Mounting of the follower rollers 403 and 404 on the slippers 164' is effected in a manner to have the axes of the rollers aligned in a common vertical plane and with the roller axes properly spaced to adapt each of the rollers to remain continuously in running contact with its associated cam track surface.

In a desirable construction, the lower roller 403 is rotatably journaled in as nearly as practicable frictionless manner by means of needle bearings 45 on a stub shaft 407 mounted fixedly on the lower portion of the block of the slipper 164'. On the other hand, the upper follower roller 404 is desirably mounted on the upper portion of the block of the slipper 164' in a spring biased floating manner for efficiently maintaining the rollers firmly in running contact with the cam track surfaces and to accommodate inevitable manufacturing tolerances. To this end, the upper roller 404 is journaled in as nearly as practicable frictionless manner as by means of needle bearings 408 on a stub shaft 409 secured fixedly to a mounting block 410 which is vertically slidably engaged in a complementary vertically extending upwardly opening guide slot 411 in the upper portion of the block of the slipper 164'. At the inner side of the guide slot 411 a pair of integral bearing flanges 412 retain the bearing block 410 in the slot 411, a collar 413 about the stub shaft 409 riding as a stabilizer between the edges of the retaining flanges 412. At the outer side of the slipper 164', a closure plate 414 secured as by means of screws 415 retains the bearing block 410 within the vertical guideway 411.

At the upper end of the guideway slot 411, a retainer cap 417 is secured over the guideway slot onto the top of the slipper 164' by means of screws 418. Housed within the cap 417 is biasing means comprising a coiled compression spring 419 which thrusts at its upper end against the cap and at its lower end against the bearing block 410 whereby to maintain a constant biasing pressure on the bearing block and thereby positively thrusting the upper roller 404 yieldably against the upper cam track surface 401. A spring guide pin 420 extends upwardly from the bearing block 410 and is freely slidable through a clearance hole 421 in the top of the cap 417. It will be appreciated, that the spring load afforded by the spring 419 in each instance will be sufficient to hold the follower rollers 403 and 404 in smooth riding engagement with the cam track surfaces 401 and 402, respectively without transition slack in the cyclical rotation of the barrel cam 146' and thus cyclical pumping action imparted to the pistons 274. Nevertheless, yieldability of the spring 419 is ample to accommodate manufacturing tolerances. In operation, the follower rollers 403 and 404 remain in continuous one way rotation with the associated cam track surfaces.

By having the lower pumping thrust rollers 403 of more massive structure both in diameter and in length, they are adequately equipped to bear the pumping loads imposed by the cam track 40 for high pressure pumping. Cooperatively for this function, the lower cam track surface 402 is of a width which undercuts an enlarged diameter upper portion 422 of the barrel cam 146' so that thrust of the cam track surface 402 during pumping stroke action is substantially in line with the upper enlarged portion 422 of the barrel cam for utmost durability in operation. To accommodate this structural relationship, the upper cam track surface 401 is narrower than the lower cam track surface 402 and the upper follower roller 404 is appropriately shorter and of smaller diameter consistent with its smaller mass because the suction loads transmitted from the cam by the rollers 404 to the pistons 274 is substantially less than the high pressure pumping loads transmitted by the rollers 403 to the pistons.

A pump as described having about 6 to 1 reduction of input speed of about 1750 rpm to about 300 rpm and a four inch stroke for 2¼inch diameter pistons, has a pumping capacity of about 80 gals./min.

Although the embodiments of the pump disclosed by way of example herein have only one unindirectional set of the pumping plunger pistons 274, it will be readily apparent that a double-acting piston arrangement can be constructed according to the principles of the present invention. For example, by suitably enlarging the diameter of the barrel cam and the pumping section of the pump, and effecting any other desirable relative dimensional revisions, a second set of pistons and pumping cylinders may be accommodated wherein the piston rods of the second set of pistons may be attached to the opposite ends of the slippers 164,164' from the ends to which the piston rods 194 are disclosed as attached. Then in each pumping cycle motion of each of the slippers 164,164' the piston attached to one end of the slipper is in a pumping stroke and the opposite piston is in a suction stroke. The oppositely directed pistons will thus pump alternately, doubling the pumping capacity of the pump while employing the same driving mechanism.

While various modifications may be suggested by those versed in the art, it should be appreciated that I wish to embody within the scope of the patent warranted hereon, all such modifications as reasonably and properly come within the scope of my contribution to the art.

I claim as my invention:

1. A multi-piston pump for displacement of liquid and particularly adapted for vertical mounting, comprising:

a pump body having an upper drive section and a lower pumping section, said drive section including a gear train mechanism positioned above cam drive means, and including planetary gears within a fixed annulus having two vertically spaced support rings and internal sun gear teeth on an inner surface between said rings;

a planet gear carrier having top and bottom spaced hub portions rotatively carried by bearing means in said annulus support rings;

planetary pinion gears rotatively carried by said planet carrier between said top and bottom hub portions;

said planet pinion gears positioned to engage with said sun gear teeth;

an input shaft having an upper end adapted for attachment to a source of rotary power, said shaft journaled in shaft bearing means carried by said planet carrier hub portions and having fixed center gear means positioned between said bearing means and drivingly meshing with said pinion gears;

said cam drive means including a barrel cam connected to said bottom hub of said planet carrier by a cam shaft carried in said drive section and corotatively connected to said bottom hub of said planet carrier by a cam shaft;

cam surface means on said barrel cam and having a sine-wave like profile for converting rotary power to reciprocating motion;

a series of slipper means reciprocable in elongated guide slots in said drive section and positioned at spaced intervals in said lower section about said barrel cam, said slipper means having inwardly projecting followers engaged with said cam profile whereby to effect reciprocation of said slipper means in cycloidal sequence as said barrel cam rotates;

fluid pumping means in said pumping section of said pump body and including a series of piston rods each having an upper end connected to said slipper means and a lower end extending into coupled engagement with upper ends of respective pistons operable in suction and pumping strokes carried in cylinders in said pumping section;

respective valve chambers in said pumping section adjacent to said cylinders and having opposite ends, and said chambers connected intermediate their ends by respective channels to suction and pumping ends of said pistons;

a respective valving assembly mounted in each of said valve chambers, each valving assembly including a one way suction valve device positioned between one side of the associated channel and one end of the chamber and a one way discharge valve device positioned between the opposite side of the associated channel and the opposite end of the chamber;

fluid intake means communicating with said one ends of said valve chambers; and outlet means communicating with said opposite ends of said valve chambers; whereby fluid is controlled by said valve devices as displaced from said intake means to said discharge means in the suction and pumping strokes, respectively, of said pistons as actuated by said cam profile in the rotation of said barrel cam.

2. A pump according to claim 1, having means carried by a bottom closure for said drive section for circulating lubricant throughout said drive section, and means drivingly connecting said lubricant circulating means to said cam shaft.

3. A pump according to claim 1, wherein said slippers have two spaced vertical guide ribs each of which has an inner surface opposing an outer surface of said pump body and an outer surface opposing a portion of a cover over the associated guide slot.

4. A pump according to claim 1, wherein said cam profile effects driving of said pistons in smooth sequential cycloidal fluid displacement and suction strokes of gradually increasing velocity at the beginning of the strokes and gradually decreasing velocity at the ends of the strokes.

5. A pump according to claim 1, wherein said piston rods extend through respective apertures in a bottom closure for said upper drive section, said apertures having an upper portion having a first diameter and a lower portion having a second diameter to form a recess below said upper portion, and a sealing device forming a seal about each of said rods and including a cup-shaped stuffing box positioned in said recess, a ring-shaped packing carried in said cup about the piston rod and retained therein by a cover plate removably attached in sealing relation to a bottom surface of said closure.

6. A pump according to claim 1, wherein said cylinders are spaced in a circular array about the vertical axis of said pump body; each cylinder having an elongate, vertical cylindrical wall with a closed bottom end and a top open end; each of said cylinders having a lower bore portion of a first diameter larger than the piston diameter and an upper counterbore portion of a second larger diameter, sealing means about the cylinder in each said counterbore preventing leakage from the cylinder during pumping actions of the piston, said sealing means including a bottom gland member having an inner circular aperture sized to allow passage of said piston and including an outwardly projecting annular flange for engaging with a shoulder at juncture of said diameters, a pair of split gland members located about each of said cylinders in said top open ends, a plurality of packing rings carried in each of said counterbores between said bottom gland member and said pair of split gland members, and fastening means for adjustably driving said split gland members compressively against said packing rings toward said bottom gland member.

7. A pump according to claim 1, wherein said valve chambers are spaced in a circular array about the vertical axis of said pump body and positioned in alternating relation between said cylinders, each of said valve chambers having an elongate vertically positioned wall, said fluid intake means including an intake passage located in the bottom of said lower pumping section, said intake passage communicating directly with the bottom end of one of said valve chambers, a central vertical space aligned with the vertical axis of said pump at the inner end of said intake passage, connecting ducts extending outwardly from said center space and communicating respectively with bottom portions of the remaining valve chambers to provide flow paths from said intake passage to said valve chambers, said outlet means including a discharge passage spaced 180 degrees from said intake passage and at an elevation above said intake passage and communicating with tops of said valve chambers.

8. A pump according to claim 1, wherein each of said valving assemblies includes a vertically oriented valve stud mounted to the bottom of said lower pumping section, to support the studs in upwardly extending relation in said valve chambers, the suction valve device being carried on each of said studs below said channel, the discharge valve device being carried on each of said studs above said channel, each of said suction and discharge valve devices including a valve seat on which is seated a spring biased valve plate to close a flow passage through said seat, said valve plates being selectively separated from said valve seats by fluid pressure differentials effected by pumping action of said pistons.

9. A pump according to claim 1, wherein said lower pumping section has an upper portion surface with a dish-shaped configuration to provide a sump, and drainage means leading from the sump.

10. A pump according to claim 1, wherein said cam surface means comprise a cam profile flange on the periphery of said barrel cam, and said cam followers for each of the pistons comprising a pair of follower members one of which follower members rides on one side of the cam flange and the other of which followers rides on the other side of the cam flange.

11. A multi-piston pump having an intake and an outlet, and comprising:

a pump body;

input shaft means carried by the pump body and adapted for connection to a source of rotary power;

speed reduction planetary gear means carried within a chamber in one section of said pump body, and having means connecting said gear means for driving by said input shaft means to develop reduced speed rotary driving output power;

a rotary barrel cam within said chamber in said one section and having a cam shaft drivingly connected to said gear means and having sine wave-like peripheral cam profile means adapted for converting said rotary output power to reciprocating motion;

a series of cam followers engaging said cam profile means and positioned at spaced intervals about said barrel cam;

respective fluid displacement pistons in a second section of said pump body and connected to said cam followers and reciprocatable in pumping strokes in respective cylinders in said pump body;

fluid intake and outlet means communicating with said cylinders;

valve means controlling displacement of fluid from said inlet means to said outlet means in the pumping strokes of said pistons;

said cam profile means driving said pistons through said followers with a cycloidal motion throughout a substantial pumping stroke range and with gradual increase and decrease of velocity at the beginning and end of stroke, respectively, with corresponding fluid motion characteristics whereby pumped fluid flow is substantially free from fluid borne pulsations;

said pistons being so phased in the series that they generate substantially continuous high pressure pumped fluid flow from said outlet;

means for circulating lubricant throughout said chamber; and means drivingly connecting said lubricant circulating means to said cam shaft.

12. A pump according to claim 11, wherein said chamber has a closure adjacent to said cam shaft, and said lubricant circulating means is carried by said closure.

13. A multi-piston pump having an intake and an outlet, comprising:

a pump body;

input shaft means carried by the pump body and adapted for connection to a source of rotary power;

speed reduction planetary gear means carried within one section of said pump body, and having means connecting said gear means for driving by said input shaft means to develop reduced speed rotary driving output power;

a rotary barrel cam drivingly connected to said gear means and having sine wave-like peripheral cam profile means adapted for converting said rotary output power to reciprocating motion;

a series of cam followers engaging said cam profile means and positioned at spaced intervals about said barrel cam;

respective fluid displacement pistons connected to said cam followers and reciprocatable in pumping and suction strokes in respective cylinders in said pump body;

respective cylindrical wall valve chambers in said pump body adjacent to said cylinders and having opposite ends, and said chambers connected intermediate their ends by respective channels to suction and pumping ends of said pistons;

a respective valving assembly mounted in each of said valve chambers, and each valving assembly including a one way suction valve device positioned between one side of the associated channel and one end of the chamber and a one way discharge valve device positioned between the opposite side of the associated channel and the opposite end of the chamber;

fluid intake means communicating with said one ends of said valve chambers;

outlet means communicating with said opposite ends of said valve chambers;

each of said valving assemblies including a fixedly mounted valve stud to extend coaxially in the associated valve chamber;

said suction valve device being carried on each of said studs between said respective channel in each instance and the suction end of the valve chamber;

said discharge valve device being carried on each of said studs between the opposite side of said respective channel and the discharge end of the valve chamber;

each of said suction and discharge valve devices including a valve seat ring mounted on said stud and engaging the associated cylindrical chamber wall and providing a valve seat facing toward said discharge end of the valve chamber, and on which valve seat in each instance is seated a spring biased valve member to close a flow passage through said valve seat ring; and said valve members being selectively alternately separated from their valve seats by fluid pressure differentials effected by pumping action of said pistons, so that in each pumping stroke of each piston its associated discharge valve device member is unseated to displace fluid to said outlet means and the associated suction valve device member is biased toward its seat by the pumping pressure, and in each suction stroke of each piston the associated suction valve device member is displaced from its seat and the associated discharge valve device member is drawn toward its seat by the suction.

14. A pump according to claim 13, wherein said valve chambers have respective access openings at one of their ends, each of said valve studs having a closure plate fixedly attached to one end portion of the stud, whereby the valve assemblies including said seat rings and said valve members can be handled as self-contained units for mounting in and removal from said valve chambers, and means removably securing said closure plates in closing relation to said access openings with said valving assemblies in said valve chambers.

* * * * *

UNITED STATES PATENT AND TRADEMARK OFFICE

CERTIFICATE OF CORRECTION

PATENT NO. : 4,195,970

DATED : April 1, 1980

INVENTOR(S) : Albert A. Zalis

It is certified that error appears in the above—identified patent and that said Letters Patent is hereby corrected as shown below:

Col. 1, line 26, for "prior", read --pump--.

Col. 3, line 13, for "piston", read --pistons--.

Col. 4, line 24, for "carrier", read --planet carrier--;

Col. 4, line 38, for "bearings", read --bearing--.

Col. 5, line 30, for "single", read --single cycle--.

Signed and Sealed this

*Seventh* Day of *April 1981*

[SEAL]

*Attest:*

RENE D. TEGTMEYER

*Attesting Officer*

*Acting Commissioner of Patents and Trademarks*